US006575610B2

(12) United States Patent
Natsume

(10) Patent No.: US 6,575,610 B2
(45) Date of Patent: Jun. 10, 2003

(54) VEHICLE INDICATOR LAMP

(75) Inventor: Kazunori Natsume, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/753,950

(22) Filed: Jan. 3, 2001

(65) Prior Publication Data

US 2001/0015898 A1 Aug. 23, 2001

(30) Foreign Application Priority Data

Jan. 6, 2000 (JP) ..... 2000-000682

(51) Int. Cl.[7] ..... F21V 17/00

(52) U.S. Cl. ..... 362/520; 362/518; 362/538; 362/308; 362/323; 362/343; 362/522

(58) Field of Search ..... 362/520, 521, 362/522, 331, 332, 337, 339, 328, 538, 539, 309, 475, 518, 308, 323, 343

(56) References Cited

U.S. PATENT DOCUMENTS 1,897,202 A * 2/1933 Lehman ..... 362/520
1,969,714 A * 8/1934 Burger ..... 362/520
4,180,849 A * 12/1979 Parkin ..... 362/521
5,081,564 A 1/1992 Mizoguchi et al.
5,556,194 A 9/1996 Natsume et al.
5,582,481 A 12/1996 Natsume
5,658,072 A 8/1997 Natsume et al.
5,692,824 A 12/1997 Ooishi
5,836,674 A 11/1998 Nishitani et al.
5,945,916 A * 8/1999 Collot ..... 362/332
6,070,993 A 6/2000 Natsume
6,406,171 B1 * 6/2002 Satsukawa et al. ..... 362/518

* cited by examiner

*Primary Examiner*—Stephen Husar
*Assistant Examiner*—Bao Truong
(74) *Attorney, Agent, or Firm*—Koda & Androlia

(57) ABSTRACT

A vehicle indicator lamp having a transparent cover that performs horizontal light radiation at a wide angle in which a reflecting surface of a reflector is formed so as to diffusion-reflect the light from a filament of the light source into a forward direction. Horizontal deflection lens portions are formed on the center area of the transparent plain cover and near the lamp's optical axis so as to horizontally deflection-permeate the direct light from the filament in a direction away from the lamp's optical axis.

9 Claims, 8 Drawing Sheets

VEHICLE INDICATOR LAMP

BACKGROUND OF THE INVENTION

1. Field of the Invention

The present invention relates to a vehicle indicator lamp that has a transparent cover and more particularly to a horizontal light irradiation mechanism of a vehicle indicator lamp.

2. Prior Art

Recently, a transparent cover has been increasingly employed in vehicle indicators instead of a front lens so as to impart transparency to lamp fixtures.

Conventionally, a reflecting mechanism has been employed in a lamp fixture for diffusion-reflecting the light from a light source forward so as to obtain a desired lamp fixture light distribution performance.

However, in a vehicle indicator lamp that uses the above-described lamp fixture, the problems as described below would occur when a wide range of horizontal light irradiation is demanded.

More specifically, in the front turn signal lamp as shown in FIG. 8, in view of improving visibility of the lamp fixture by a driver of another vehicle, it is desired that light irradiation is performed in a light distribution pattern that horizontally diffuses light to the inside with respect to the width of the vehicle at around 45° and also to the outside with respect to the width of the vehicle at around 80° relative to the optical axis Ax of the lamp that extends in the longitudinal direction of the lamp. However, the lamp fixture in which the light from light source 4 is diffusion-reflected forward by a reflector 2 as shown in FIG. 8 does not make the light irradiation at a wide horizontal diffusion angle due to its structure. Direct light from the light source 4 is merely directly diffusion-irradiated through the transparent cover 6. Therefore, it is not possible to perform light irradiation at an angle that exceeds the angle θ defined by the positional relationship between the light source 4 and the side edge of the transparent cover 6.

BRIEF SUMMARY OF THE INVENTION

In view of the above disadvantage with the prior art, the object of the invention is to provide a vehicle indicator lamp that has a transparent cover and is capable of performing horizontal light irradiation at a wide angle.

In the present invention, the above object is accomplished by a unique structure for a transparent cover structure.

More specifically, the present invention is for a vehicle indicator lamp that has a light source disposed on its optical axis, a reflector having a reflecting surface that diffusion-reflects the light from the light source forward, and a transparent plain cover provided in front of the reflector; and in the present invention, a horizontal deflection lens portion is formed in the center area of the transparent cover and near the lamp's optical axis so that the horizontal deflection lens horizontally deflection-permeates the direct light from the light source in a direction away from the lamp's optical axis.

The "transparent cover" is not limited to a particular structure so long as it is transparent and plain. It may be disposed in the position of an outer lens (normally employed as a front lens) or disposed in the position of an inner lens within the lamp fixture.

The "horizontal deflection lens portion" is not limited to a particular structure so long as it can horizontally deflection-permeate the direct light from the light source in a direction away from the lamp's optical axis. For example, the "horizontal deflection lens portion" can be formed of a single lens element or a plurality of lens elements. It can be formed on the front surface or on the rear surface, or it can be formed on both front and rear surfaces of the transparent cover. Furthermore, the "horizontal deflection lens portion" can be formed over the center area entirely, or such a portion can be formed on just a part thereof.

As seen from the above, in the vehicle indicator lamp according to the present invention, the reflecting surface of the reflector diffusion-reflects the light from the light source forward, and the transparent plain cover is disposed in front of the reflector. Accordingly, a predetermined light distribution can be obtained while imparting transparency to the lamp fixture. Furthermore, the horizontal deflection lens portion that horizontal deflection-permeates the direct light from the light source in a direction away from the optical axis is provided, and such a lens portion is formed on the center area of the transparent cover and near the lamp's optical axis. Accordingly, it is possible to perform light irradiation at a wide horizontal diffusion angle that has never been achieved by conventional art, since the light irradiation of conventional art is performed only with the diffusion reflecting light from the reflector and with the direct light that is from the light source and merely passes through the transparent cover.

In view of the above, the present invention provides a vehicle indicator lamp having a transparent cover that performs a horizontal light irradiation at a wider angle.

With the horizontal deflection lens portion formed on the center area of the transparent cover as described above, this area is no longer plain. However, the light source bulb is positioned in the back of such a center area. Accordingly, the area of the reflecting surface of the reflector, which is shielded by the horizontal deflection lens portion and is not visible when the lamp fixture is viewed from the front, is quite small. The horizontal deflection lens portion, on the other hand, prevents the light source bulb, the portion where the light source bulb is attached to the reflector, etc., from being viewed from the front. Moreover, the horizontal deflection lens portion can appear to be floating in the center area of the transparent cover, while the reflecting surface of the reflector can appear to be far in the back through the plain peripheral portion. Accordingly, the lamp fixture of the present invention provides a good three-dimensionality and depth. Therefore, the present invention improves the appearance of a lamp fixture compared to that of a lamp fixture in which the whole area of the transparent cover is formed plain.

The structure of the "reflecting surface" is not limited to particular one so long as it diffusion-reflects the light from the light source forward. However, it can be designed so that substantially the entire amount of reflecting light from the reflecting surface is irradiated to the peripheral area at the outer periphery of the center area of the transparent cover. With this structure, diffusion-reflecting control by the reflecting surface and deflection permeation control by the horizontal deflection lens portion can be separately performed almost completely. Thus, the lamp fixture performs light diffusion control with high accuracy.

The degree of horizontal deflection angle of the direct light from the light source by the "horizontal deflection lens portion" is not limited to a particular angle. It is preferable that at least a portion of the horizontal deflection lens portion is formed so as to horizontally emit the direct light from the light source to the lamp's optical axis at an opening angle of 60° or greater. With this structure, the visibility of the lamp fixture by a driver of another vehicle can be sufficiently improved.

In the above structure, the horizontal deflection lens portion can be formed of a plurality of lens elements divided into vertical stripes. With this structure, the deflection permeation light can be obtained in the form of a collection of the deflection permeation light from the respective lens elements. As a result, an even more accurate deflection permeation control can be performed.

In the above case, each of the lens elements can be formed so as to enable the direct light from the light source to deflection-permeate only by the refractive action. If the direct light from the light source is deflection-permeated using not only the refractive action but also the internal reflecting action, the light irradiation can be performed at a further wider angle.

DETAILED DESCRIPTION OF THE INVENTION

The present invention will hereinafter be describes with reference to the accompanying drawings.

Figure 1:
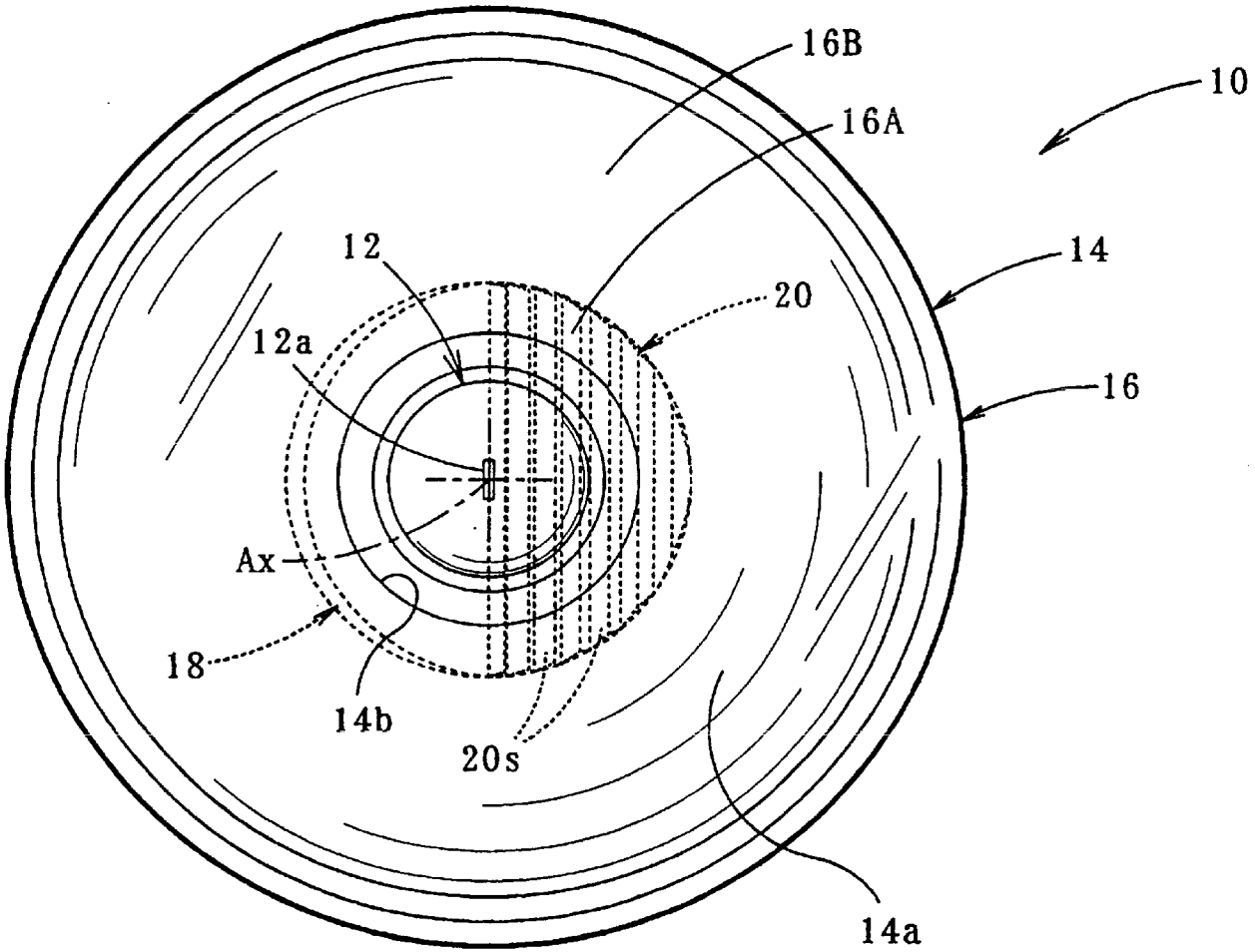
FIG. 1 is a front view of a vehicle indicator lamp according to one embodiment of the present invention.
Figure 2:
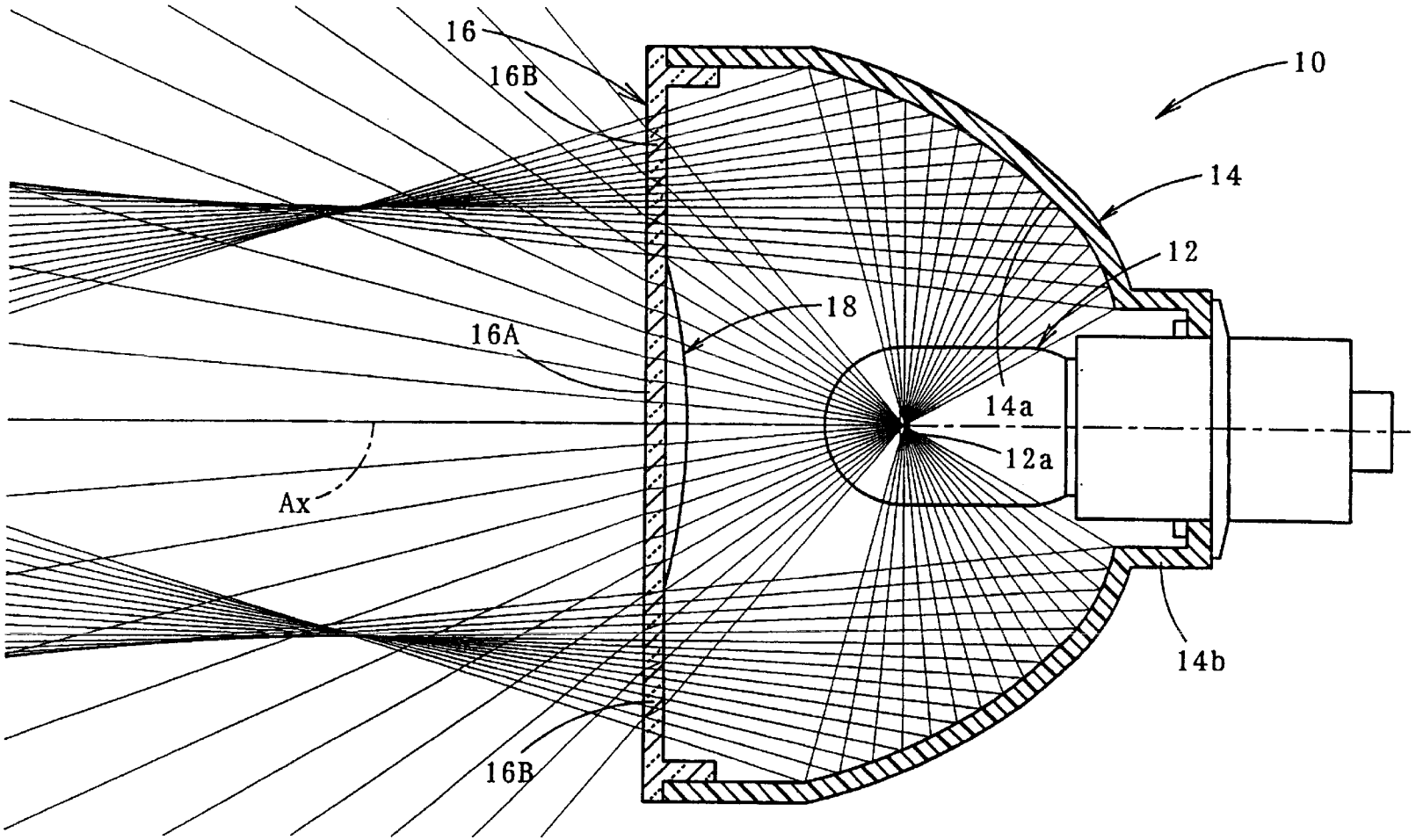
FIG. 2 is a vertical cross-sectional view of the vehicle indicator lamp.

As seen from FIGS. 1–3, the vehicle indicator lamp 10 of the present invention will be described with reference to a front turn signal lamp mounted on the left front end of a vehicle body. The indicator lamp 10 includes a light source bulb 12 disposed on the lamp's optical axis Ax extending in the longitudinal direction of the vehicle, a reflector 14 having a reflecting surface 14*a* for reflecting the light from a filament 12*a* (light source) of the light source bulb 12 forward, and a transparent plain cover 16 disposed in front of the reflector 14.

The vehicle indicator lamp 10 has a circular shape with its optical axis Ax at the center when the lamp fixture is viewed from the front. At the outer peripheral edge of the vehicle indicator lamp 10, a transparent cover 16 is welded to the reflector 14.

The light source bulb 12 is installed at the rear apex of the reflector 14, and its filament 12*a* is set so as to vertically extend on the optical axis Ax.

A pair of right and left horizontal deflection lens portions 18 and 20 are formed on the back surface of the center area 16A of the transparent cover 16 so that the deflection lens portions are in the vicinity of the optical axis Ax and the direct light from the filament 12*a* is horizontally deflection-permeated in a direction away from the optical axis Ax. The center area 16A of the cover 16 has a circular shape with the optical axis Ax as the center. The diameter of the center area 16A is set to a value that is slightly larger than that of the inner diameter of a bulb insertion cylindrical portion 14*b* of the reflector 14. The peripheral area 16B surrounding the center area 16A of the transparent cover 16 is formed plain.

The reflecting surface 14*a* of the reflector 14 is formed so as to diffusion-reflect the light from the filament 12*a* forward. The reflecting surface 14*a* has a single curved surface, and the light reflecting therefrom is radially converged relative to the optical axis Ax. As a result, substantially the entire amount of reflecting light is irradiated to the peripheral area 16B of the transparent cover 16.

The light reflecting from the reflecting surface 14*a* permeates through the transparent cover 16, which is once converged and then irradiated forward as the diffusion light. It is preferable that the horizontal diffusion angle be set to a value larger than that of the vertical diffusion angle in view of the light distribution performance of the lamp fixture. Therefore, the curved shape of the reflecting surface 14*a* is designed so that the convergence degree of the reflecting light from the vertical cross section to the horizontal cross section is gradually intensified. The forward light irradiation is, thus, to be performed at a vertical diffusion angle of about 20° and a horizontal diffusion angle of about 30°. The light distribution normally performed by the lamp fixture can be derived from the light that reflects from the reflecting surface 14*a*.

Figure 3:
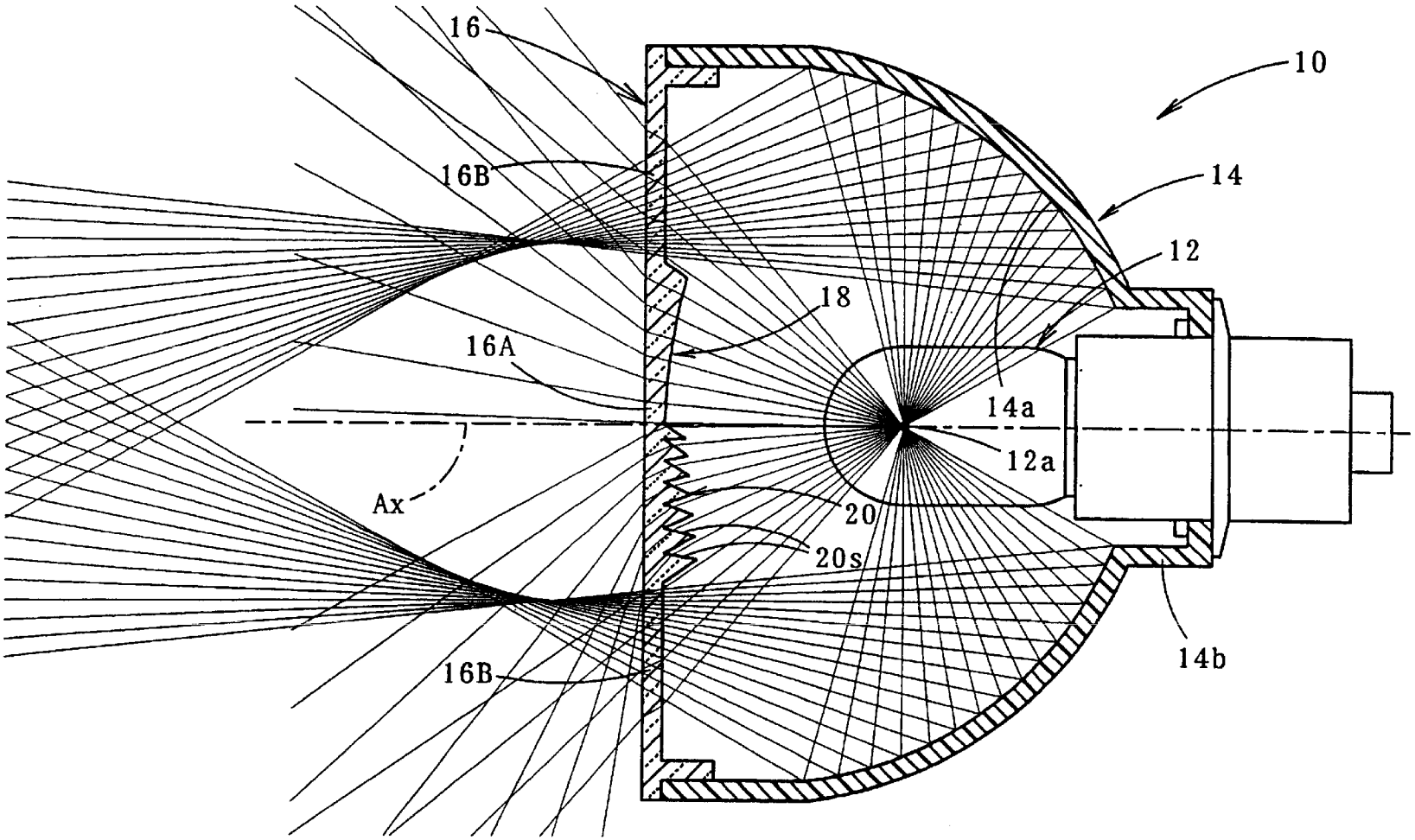
FIG. 3 is a horizontal sectional view of the vehicle indicator lamp.
Figure 4:
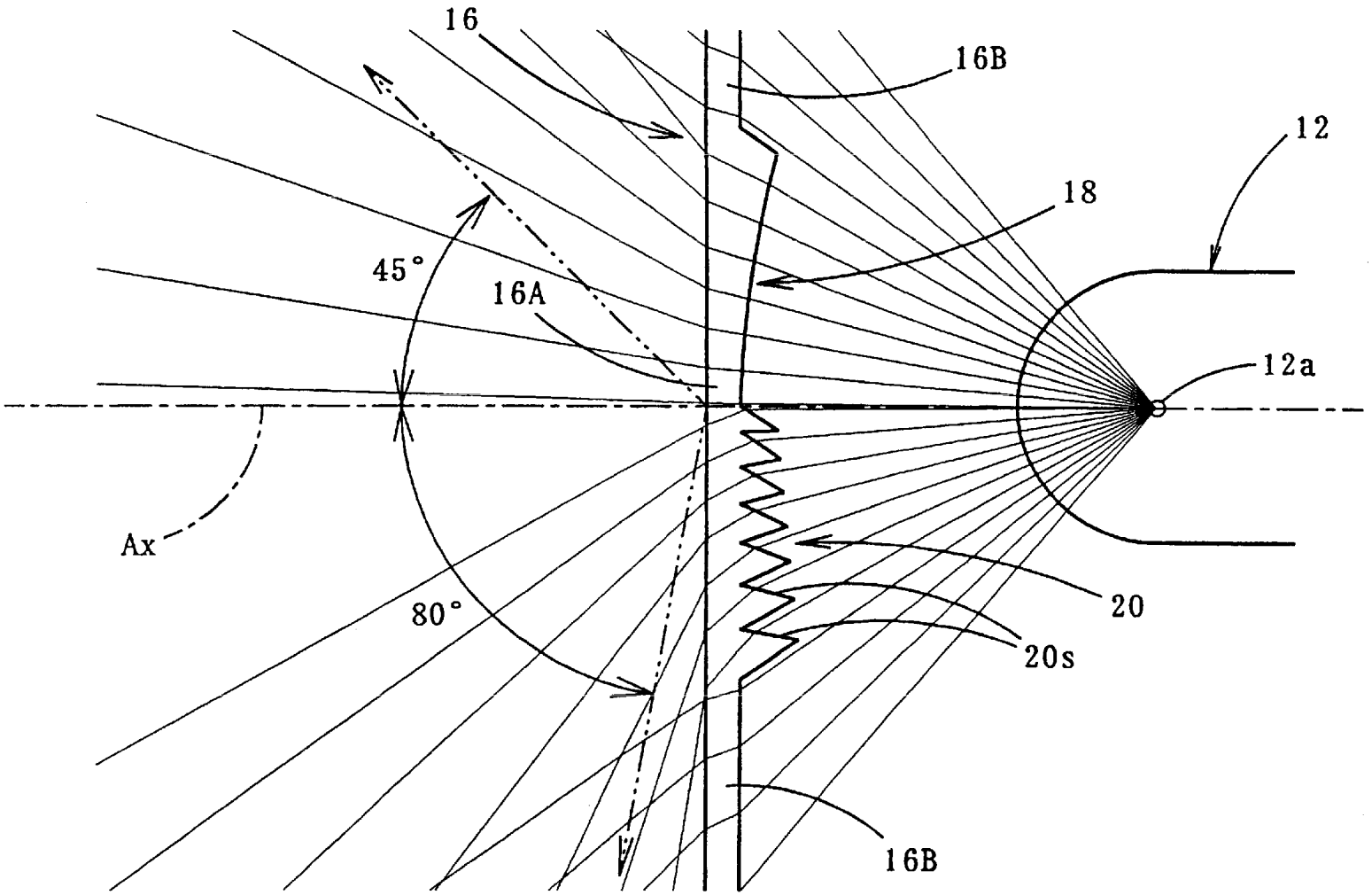
FIG. 4 is an enlarged, detailed view of FIG. 3.

FIG. 4 shows the detail of the essential portion of the vehicle indicator lamp shown in FIG. 3.

As seen from FIG. 4, of the horizontal deflection lens portions 18 and 20 which are a right and left pair, the horizontal deflection lens portion 18 located on the right side (that is, the inside in the lateral direction of the vehicle) is formed as a vertically extending single concave cylindrical lens with an arc-like horizontal cross section. The horizontal deflection lens portion 20 located on the left side (that is, the outside in the lateral direction of the vehicle) is formed of a plurality of prism lens elements 20*s* divided into vertical stripes. Each of the vertical stripes has a wedge-like horizontal cross section and extends vertically.

The right-side horizontal deflection lens portion 18 is formed of a concave cylindrical lens having a surface so as to diffuse the direct light from the filament 12*a* irradiating at an opening angle of around 0° to 30° with respect to the optical axis Ax rightward and emit the diffused light at an opening angle of around 0° to 55° with respect to the optical axis Ax.

The left-side horizontal deflection lens portion 20 is formed of a plurality of prism lens elements 20*s*. Each of the prism lens elements 20*s* has a surface that diffuses the direct light from the filament 12*a* irradiating at an opening angle of around 0° to 30° with respect to the optical axis Ax leftward and emits the diffused light at an opening angle of around 30° to 85° with respect to the optical axis Ax.

Figure 5:
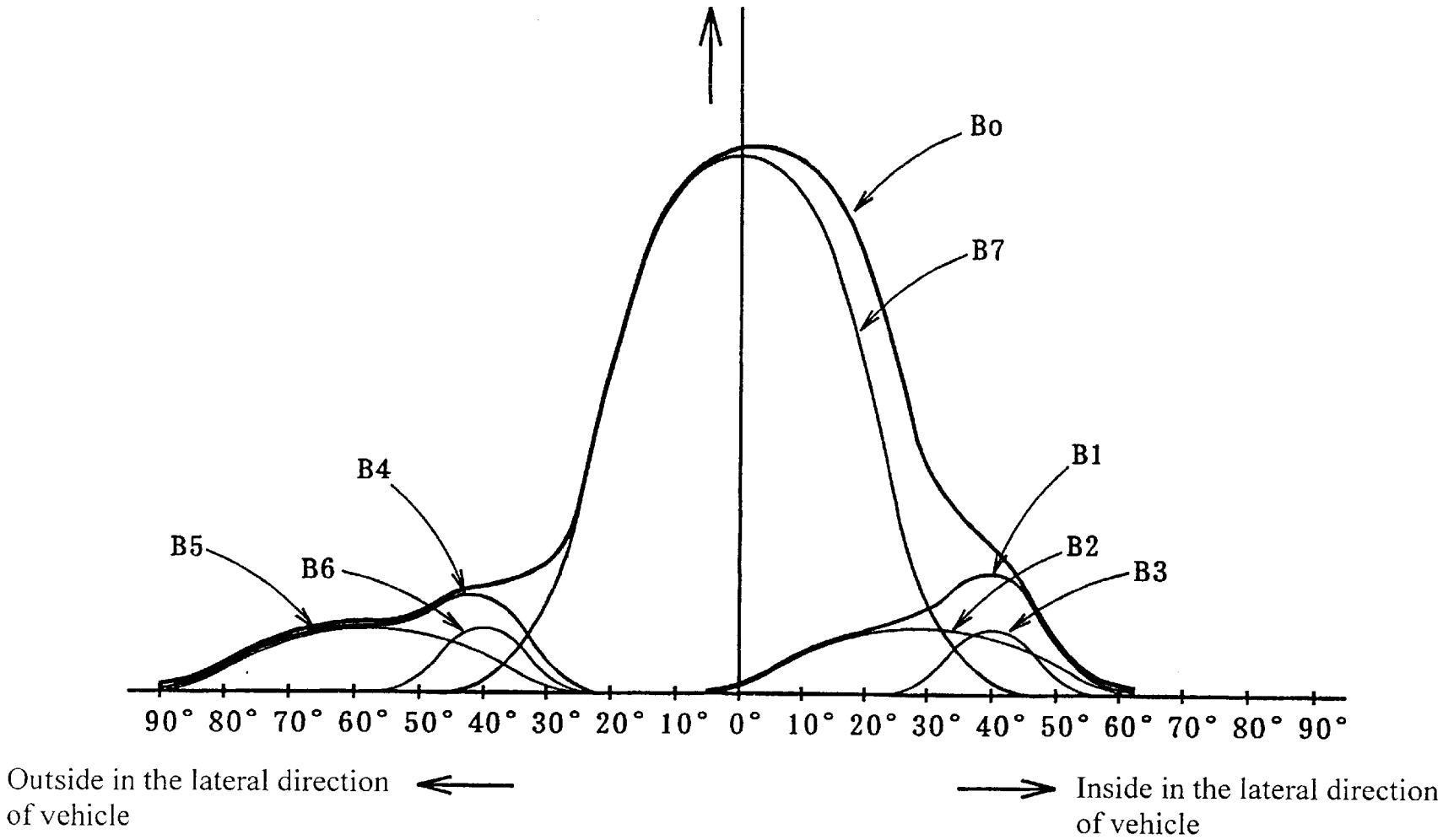
FIG. 5 shows a graph of the illuminance distribution at the horizontal cross section including the lamp's optical axis of the forward light irradiated from the vehicle indicator lamp.

FIG. 5 shows the illuminance distribution at the horizontal cross section including the optical axis Ax of the forwarded light irradiated from the indicator lamp 10.

As seen from FIG. 5, light B1 of the direct light from the filament 12*a*, which is irradiated rightward of the optical axis Ax, is formed by superposing light B2 and light B3. Light B2 is an irradiated light that permeates through the right-side horizontal deflection lens portion 18 of the center area 16A at an opening angle of about 0° to 55° with respect to the optical axis Ax. Light B3 is an irradiated light that permeates the peripheral area 16B at an opening angle of about 30° to 50° with respect to the optical axis Ax.

Light B4 of the direct light from the filament 12*a*, which is irradiated leftward of the optical axis Ax, is formed by superposing light B5 and light B6. Light B5 is an irradiated light that permeates through the left-side horizontal reflecting lens portion 20 of the center area 16A at an opening angle of about 30 to 85° with respect to the optical axis Ax. Light B6 is an irradiated light that permeates the peripheral area 16B at an opening angle of about 30 to 50° with respect to the optical axis Ax.

Light Bo irradiated forward from the vehicle indicator lamp 10 is formed by superposing the direct light B1 and B4 from the filament 12*a* and the irradiating light B7 of the light reflecting from the reflecting surface 14*a*, in which the irradiating light B7 is irradiated at the opening angle of about 30° both rightward and leftward with respect to the optical axis Ax. The resultant light is irradiated at an opening angle of about 85° on the left side and about 55° on the right side with respect to the optical axis Ax.

Figure 6:
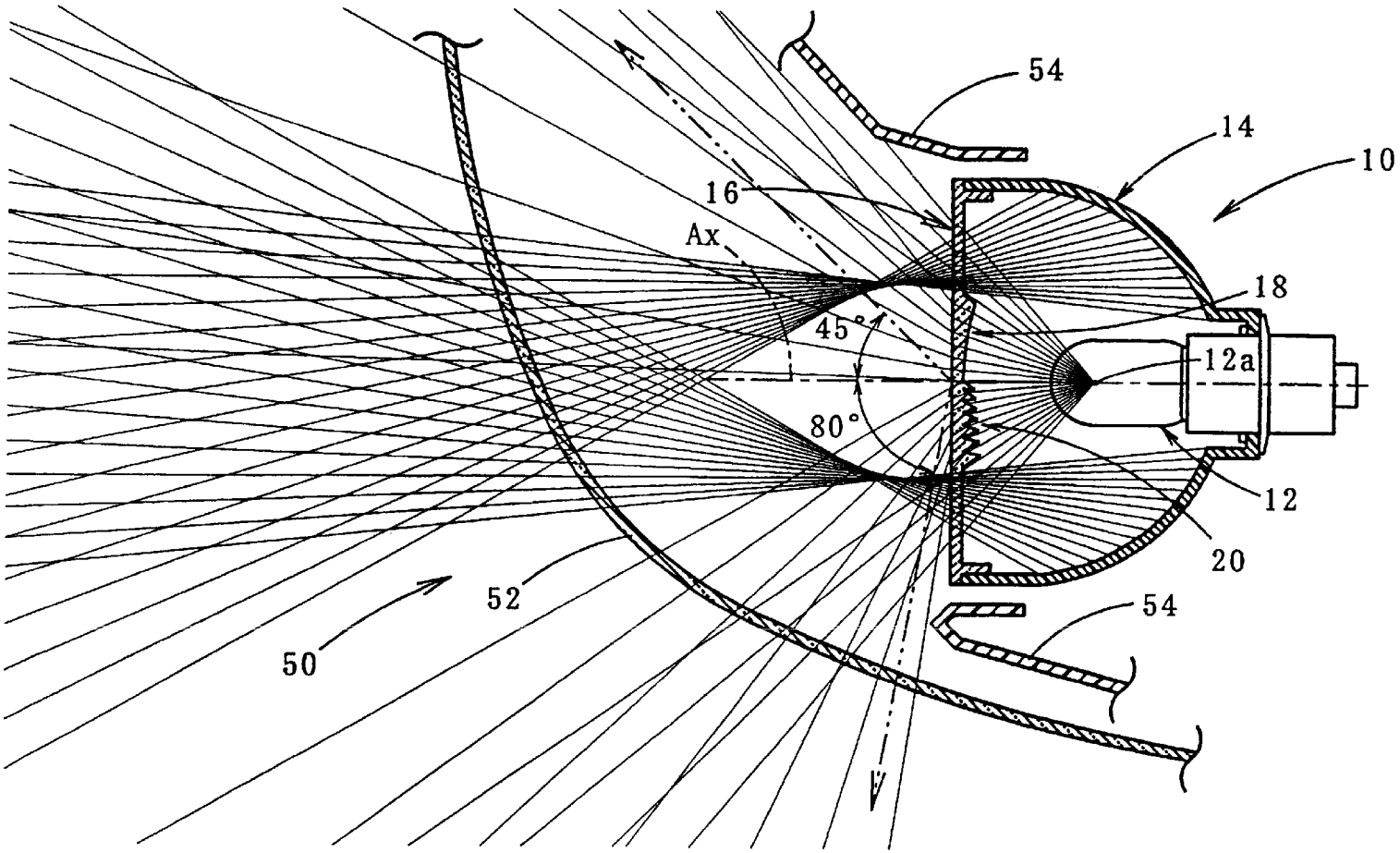
FIG. 6 is a horizontal sectional view of a part of a lamp fixture in which the vehicle indicator lamp is combined as a lamp fixture unit.

FIG. 6 shows a part of a lamp fixture 50 in which the above-described vehicle indicator lamp 10 is combined as a lamp fixture unit.

The lamp fixture 50 includes a plain outer hood 52 provided in front of the vehicle indicator lamp 10 and an extension panel 54 provided around the indicator lamp 10.

The outer hood 52 has a horizontal cross section that curves along with the surface configuration of the front left end portion of the vehicle body. The extension panel 54 surrounds the front end portion of the vehicle indicator lamp 10. The right side of the extension panel 54 extends diagonally forward, and the left side thereof extends diagonally rearward. With this design, the extension panel 54 matches the design of the outer hood 52. In addition, the extension panel 54 substantially prevents the light, which is irradiated from the vehicle indicator lamp 10 forward at an opening angle of about 85° on the left side and about 55° on the right side with respect to the optical axis Ax, from being shielded.

As described above in detail, in the vehicle indicator lamp according to the present invention, the reflecting surface 14*a* of the reflector 14 diffusion-reflects the light from the filament 12*a* forward, and the transparent plain cover 16 is disposed in front of the reflector 14. As a result, a predetermined light distribution performance can be obtained while imparting transparency to the lamp fixture. In addition, the horizontal deflection lens portions 18 and 20 for horizontally deflection-permeating the direct light from the filament 12*a* in a direction away from the optical axis Ax is formed on the center area 16A of the transparent cover 16 and in the vicinity of the optical axis Ax. Accordingly, it is possible to perform light irradiation at a wide horizontal diffusion angle which has never been achieved by the conventional art in which the light irradiation is performed with the diffusion-reflecting light from the reflector and the direct light that is from the light source and just passes through the transparent cover.

As seen from the above, according to the present invention, a vehicle indicator lamp that has a transparent cover and performs horizontal light irradiation at a wider angle can be obtained.

When the horizontal deflection lens portions 18 and 20 are formed in the center area 16A of the transparent cover 16 as described above, such an area is no longer plain. However, the light source bulb 12 is located behind the center area 16A. Accordingly, the area of the reflecting surface 14*a* of the reflector 14, which is shielded by the horizontal deflection lens portions 18 and 20 and not visible when the lamp fixture is viewed from the front, is quite small. The horizontal deflection lens portions 18 and 20 prevent the light source bulb 12 or the portion where the light source bulb 12 is attached to the reflector 14 from being visible. Moreover, the horizontal deflection lens portions 18 and 20 appear to be floating in the center area 16A of the transparent cover 16, while the reflecting surface 14*a* of the reflector 14 appears to be far in the back through the plain peripheral portion 16B. This gives three-dimensionality and depth to the lamp fixture. Therefore, the present invention can improve the appearance of a lamp fixture compared to that of a lamp fixture in which the whole area of the transparent cover is formed plain.

In the above-described embodiment, the reflecting surface 14*a* of the reflector 14 is structured so as to irradiate substantially the entire amount of the light reflecting therefrom to the peripheral area 16B of the transparent cover 16. Therefore, diffusion-reflection control by the reflecting surface 14*a* and deflection permeation control by the horizontal deflection lens portions 18 and 20 can be separately performed almost completely, and the lamp fixture can perform light distribution with high accuracy.

In addition, in the above embodiment, the direct light from the filament 12*a* is deflected by the right-side horizontal deflection lens portion 18 inwardly in the lateral direction of the vehicle at about 55° and deflected by the left-side horizontal deflection lens portion 20 outwardly in the lateral direction of the vehicle up to about 85°. With this structure, visibility of the lamp fixture experienced by the driver of another vehicle can be sufficiently improved, and the function of the front turn signal lamp can be enhanced.

In the above structure, the left-side horizontal deflection lens portion 20 for performing deflection at the large angle of up to about 85° comprises a plurality of prism lens elements 20*s* of a vertical stripe shape. Thus, the light deflection-permeated through the left-side horizontal deflection lens portion 20 is obtained as a collection of the light deflection-permeated through each of the prism lens elements 20*s*. It is, accordingly, possible to perform deflection-permeation control at a wider angle with high accuracy.

Figure 7:
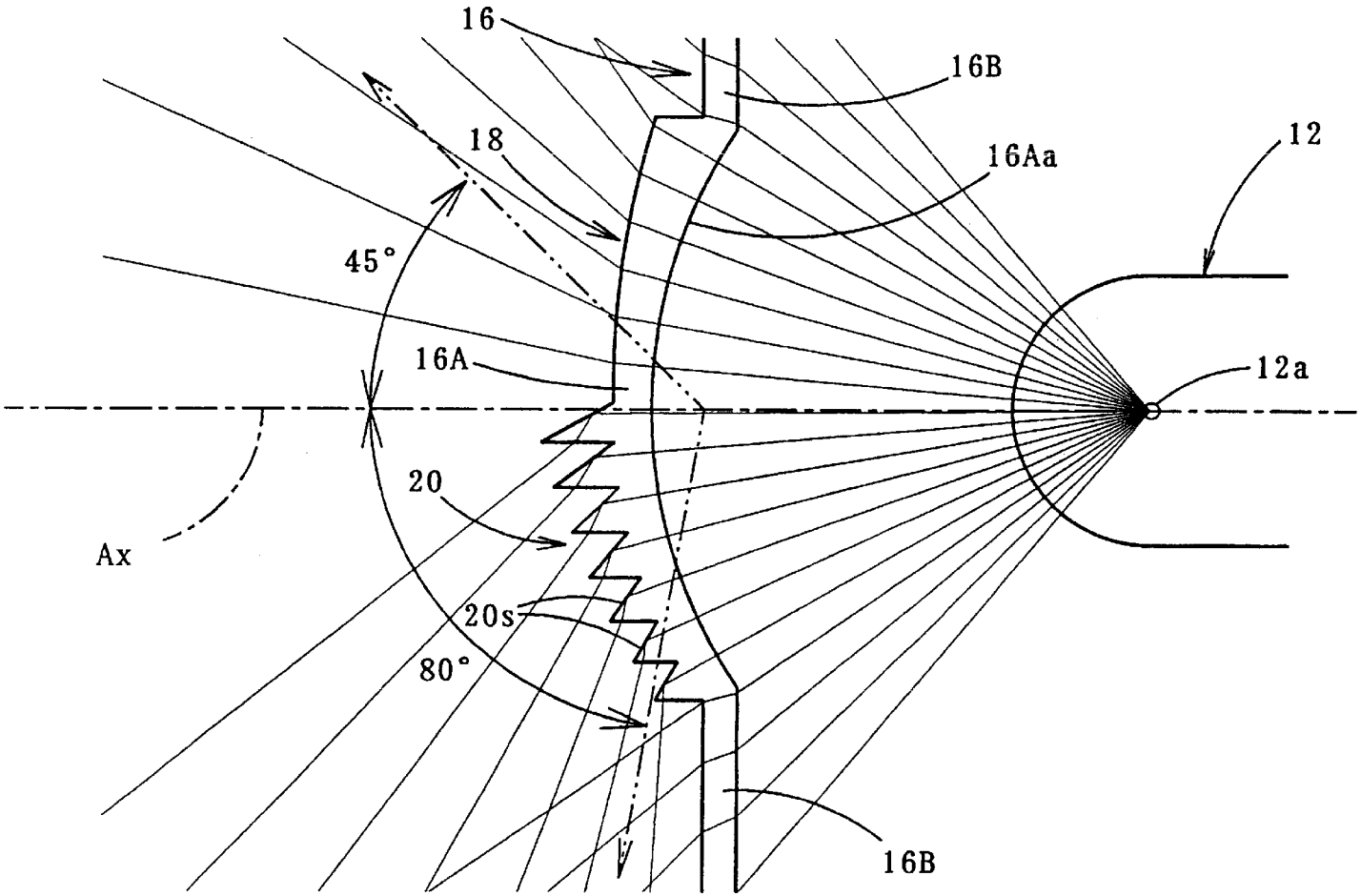
FIG. 7 shows a modified example of the horizontal deflection lens portions of the present embodiment illustrated in a similar manner as that FIG. 4.
Figure 8:
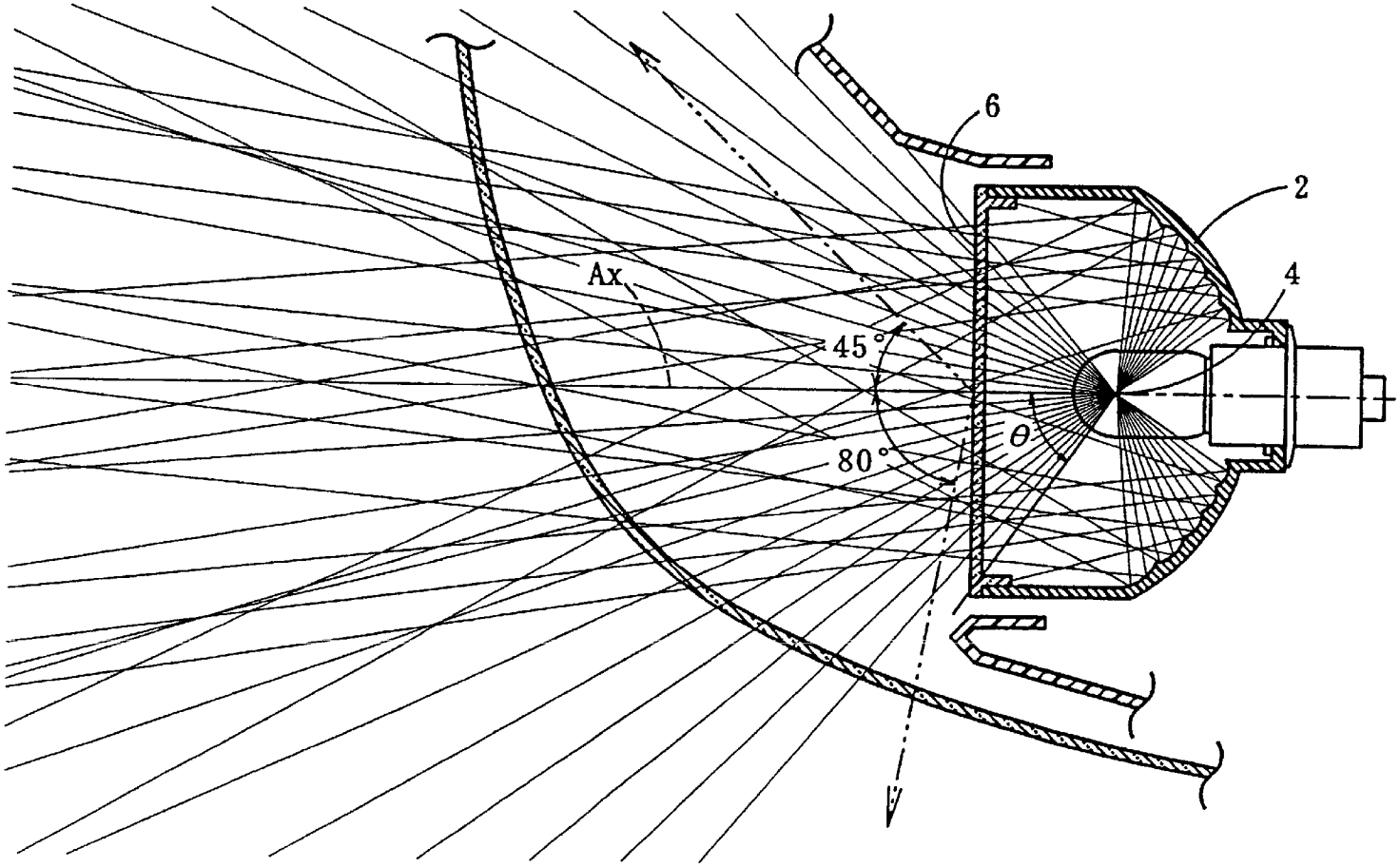
FIG. 8 PRIOR ART
FIG. 8 is a horizontal sectional view of a prior art lamp fixture shown in a similar manner as in FIG. 6.

FIG. 7 shows a modified example of the horizontal deflection lens portions 18 and 20 of the present embodiment.

In the embodiment shown in FIGS. 1 through 6, particularly in FIG. 4, the horizontal deflection lens portions 18 and 20 are formed on the back surface of the center area 16A. To the contrary, in the embodiment shown in FIG. 7, the horizontal deflection lens portions 18 and 20 are formed on the front and back surfaces of the center area 16A, respectively.

More specifically, the back surface 16Aa of the center area 16A of the transparent plain cover 16 is formed as a single cylindrical concave surface vertically extending and having an arc-like horizontal cross section with the filament 12*a* as the center. The horizontal deflection lens portion 18 in the center area 16A is formed as a cylindrical concave lens by forming a right-side half of the front surface of the center area 16A into a cylindrical concave surface with its curvature smaller than that of the cylindrical concave surface of the back surface 16Aa. On the other hand, the horizontal deflection lens portion 20 is formed of a plurality of prism lens elements 20*s* by dividing the left half of the front surface of the center area 16A into vertical stripes.

Like the embodiment of FIG. 4, the right-side horizontal deflection lens portion 18 of the embodiment of FIG. 7 deflection-permeates the direct light from the filament 12*a* using its refractive action. In the embodiment of FIG. 4, the left horizontal deflection lens portion 20 deflection-permeates the direct light from the filament 12*a* using the refractive action of each of the respective prism lens elements 20*s*. However, the left-side horizontal deflection lens portion 20 of the embodiment of FIG. 7 deflection-permeates the direct light from the filament 12*a* by way of using the internal reflecting action and the refractive action of each of the prism lens elements 20*s*.

With the structure of the embodiment of FIG. 7, the direct light from the filament 12*a* is vertically irradiated to the horizontal deflection lens portions 18 and 20, and the light path calculation becomes simple. In addition, horizontal light irradiation can be performed at a wider angle compared to the embodiment of FIG. 4.

In the above-described embodiments, the right and left horizontal deflection lens portions 18 and 20 are formed on the center area 16A. The right half of the center area 16A can be formed to be plain without forming the right-side horizontal deflection lens portion 18. In this case, the light irradiated rightward of the optical axis Ax at 45° is derived from the direct light just permeating from the filament 12*a* through the transparent cover 16. It is, however, preferable to form the right-side horizontal deflection lens portion 18 in a similar manner to the above-described embodiments so as to intensify the light irradiated rightward at 45° in view of improving visibility of the lamp fixture experienced by the driver of another vehicle.

In the embodiments described above, the vehicle indicator lamp 10 is a front turn signal lamp. It should be noted that other kinds of vehicle indicator lamps provide the same advantageous effects by having the same structure as that employed in the foregoing embodiments.

What is claimed is:

1. A vehicle indicator lamp comprising: a light source disposed on an optical axis of said lamp, a reflector with a reflecting surface formed so as to diffusion-reflect light from said light source forward, and a transparent plain cover provided in front of said reflector, characterized in that a horizontal deflection lens portion is formed on a center area of said transparent plain cover and in the vicinity of said optical axis so as to horizontally deflection-permeate direct light from said light source in a direction away from said optical axis and said reflecting surface is formed so as to irradiate substantially an entire amount of light reflecting from said reflecting surface to a peripheral area at an outer periphery of the center area of said transparent plain cover, and wherein light reflecting from the reflecting surface is radially converged relative to the optical axis and light reflecting from the reflecting surface permeates through the transparent plain cover which is once vertically and horizontally converged and then irradiated as diffusion light forward, and said horizontal deflection lens portion is formed with a plurality of lens elements divided into vertical stripes.

2. The vehicle indicator lamp according to claim 1, characterized in that at least a part of said horizontal deflection lens portion is formed so as to horizontally emit said direct light from said light source at an opening angle of 60° or greater with respect to said optical axis.

3. A vehicle indicator lamp comprising: a light source disposed on an optical axis of said lamp, a reflector wit a reflecting surface formed so as to diffusion-reflect light from said light source forward, and a transparent plain cover provided in front of said reflector, characterized in that a horizontal deflection lens portion is formed on a center area of said transparent plain cover and in the vicinity of said optical axis so as to horizontally deflection-permeate direct light from said light source in a direction away from said optical axis and said reflecting surface is formed so as to irradiate substantially an entire amount of light reflecting from said reflecting surface to a peripheral area at an outer periphery of the center area of said transparent plain cover, and wherein light reflecting from the reflecting surface is radially converged relative to the optical axis and light reflecting from the reflecting surface permeates through the transparent plain cover which is once vertically and horizontally converged and then irradiated as diffusion light forward, and said horizontal deflection lens portion is formed as a vertically extending single concave cylindrical lens with an arc-like horizontal cross section.

4. The vehicle indicator lamp according to claim 3, characterized in that at least a part of said horizontal deflection lens portion is formed so as to horizontally emit said direct light from said light source at an opening angle of 60° or greater with respect to said optical axis.

5. The vehicle indicator lamp according to claim 1, characterized in that each of said plurality of lens elements is formed so as to deflection-permeate said direct light from said light source using internal refraction of each of said plurality of lens elements.

6. The vehicle indicator lamp according to claim 4, characterized in that said horizontal deflection lens portion is formed with a plurality of lens elements divided into vertical stripes.

7. The vehicle indicator lamp according to claim 1, characterized in that each of said plurality of lens elements is formed so as to deflection-permeate said direct light from said light source using internal refraction of each of said plurality of lens elements.

8. The vehicle indicator lamp according to claim 2, characterized in that said horizontal deflection lens portion is formed with a plurality of lens elements divided into vertical stripes.

9. The vehicle indicator lamp according to claim 8, characterized in that each of said plurality of lens elements is formed so as to deflection-permeate said direct light from said light source using internal refraction of each of said plurality of lens elements.

* * * * *